US006569289B2

(12) United States Patent
Stromberg et al.

(10) Patent No.: US 6,569,289 B2
(45) Date of Patent: May 27, 2003

(54) CELLULOSE SLURRY TREATING SYSTEMS FOR ADDING AQ TO A CELLULOSE SLURRY IN THE SUBSTANTIAL ABSENCE OF ALKALI

(75) Inventors: C. Bertil Stromberg, Glens Falls, NY (US); Joseph R. Phillips, Queensbury, NY (US)

(73) Assignee: Andritz Inc., Glen Falls, NY (US)

( * ) Notice: Subject to any disclaimer, the term of this patent is extended or adjusted under 35 U.S.C. 154(b) by 0 days.

(21) Appl. No.: 09/987,596

(22) Filed: Nov. 15, 2001

(65) Prior Publication Data

US 2002/0026991 A1 Mar. 7, 2002

Related U.S. Application Data

(62) Division of application No. 09/658,910, filed on Sep. 12, 2000.

(60) Provisional application No. 60/153,237, filed on Sep. 13, 1999.

(51) Int. Cl.[7] ..... D21C 3/20; D21C 3/24; D21C 3/26; D21C 7/06; D21C 7/14

(52) U.S. Cl. ..... 162/237; 162/246; 162/251

(58) Field of Search ..... 162/52, 246, 72, 162/19, 82, 90, 41, 237, 251

(56) References Cited

U.S. PATENT DOCUMENTS

| | | | |
|---|---|---|---|
| 2,944,928 | A | 7/1960 | Kibrick et al. |
| 3,210,235 | A | 10/1965 | Ferrigan, Jr. et al. |
| 3,888,727 | A | 6/1975 | Kenit |
| 4,012,280 | A | 3/1977 | Holton |
| 4,024,229 | A | 5/1977 | Smith et al. |
| 4,091,749 | A | 5/1978 | Procter et al. |
| 4,127,439 | A | 11/1978 | Fujii et al. |
| 4,310,383 | A | 1/1982 | Fujii et al. |
| 4,599,138 | A | 7/1986 | Lindahl |
| 5,489,363 | A | 2/1996 | Marcoccia et al. |
| 5,536,366 | A | 7/1996 | Marcoccia et al. |
| 5,547,012 | A | 8/1996 | Marcoccia et al. |
| 5,575,890 | A | 11/1996 | Prough et al. |
| 5,620,562 | A | 4/1997 | Marcoccia et al. |
| 5,662,775 | A | 9/1997 | Marcoccia et al. |

FOREIGN PATENT DOCUMENTS

| | | |
|---|---|---|
| CA | 444274 | of 0000 |
| CA | 873779 | 6/1971 |
| CA | 1324377 | 11/1993 |
| WO | WO 98/13547 | 4/1998 |
| WO | WO 01/21882 A1 | 3/2001 |

OTHER PUBLICATIONS

Holton, "Better Cooking with Anthraquinone", PPI, pp. 49–52, Aug. 1978.

Marcoccla et al, Lo–Solids® Cooking Continuous To Evolve: (the EAPC™ Processes), 11 pages.

Lindström et al, "The effect of polysulfide pretreatment when kraft pulping to very low kappa numbers", Nordic Pulp and Paper Research Journal No. Jan. 1995, pp. 8–11.

(List continued on next page.)

*Primary Examiner*—Marc S Alvo
(74) *Attorney, Agent, or Firm*—Nixon & Vanderhye P.C.

(57) ABSTRACT

Chemical pulp is produced from a slurry of comminuted cellulosic fibrous material using a beneficial additive such as AQ, or polysulfide. In the first treatment zone the effective alkali concentration and temperature conditions are such so that substantially no alkali degradation of the cellulose occurs, but so that the material is effectively impregnated with the additive. Then the material is treated with an alkaline cooking liquor, at cooking temperature, to produce a chemical cellulose pulp with higher yield or strength than if the low temperature, low alkali, additive pretreatment was not practiced. Typical alkali and temperature conditions in the first zone are less than 10 g/l expressed as NaOH; and between about 80–130° C., e.g. about 80–110° C. The first zone is preferably a feed system (which may include a separate impregnation vessel) for a continuous digester, while cooking is in a continuous digester.

2 Claims, 1 Drawing Sheet

OTHER PUBLICATIONS

Sanyer et al, "Factors Affecting Yield Increase and Fiber Quality in Polysulfide Pulping of Loblolly Pine, Other Softwoods, and Red Oak", TAPPI, vol. 47, No. 10, Oct. 1964, pp. 640–651.
Jiang et al and Lowe et al, "Extended Modifide Cooking of Southern Pine with Polysulfied—Effect on Elemental–Chlorine–Free Bleaching", Poster Presentation at the 1994 International Pulp Bleaching Conference, Vancouver, Canada, Jun. 13–16, 8 pages.
Jameel et al, "Extending delignification with AQ/polysulfide", TAPPI Journal, vol. 78, No. 9, Sep. 1995, pp. 151–160.
Li et al, "The Modification of Multi–Stage Polysulfide Pulping to Improve Pulping Selectivity", Pulp and Paper Research Institute of Canada, Quebec, Canada, H9R 3J9, 6 pages.
Osmo Pekkaal, "On the extended delignification using polysulfide or anthraquinone in kraft pulping", Paper And Timber, vol. 11, 1982, pp. 735–744.
Tench et al, "Mill Scale Implementation of Paprican's Process for Polysulfide Liquor Production in Kraft Mill Causticizers—Part 1; Batch Trials and Process Optimization", 1998 Pulping Conference, pp. 571–592.
Hu et al, "Polysulfide Pulping of Softwood Using Oxidized Mill White Liquor Generated from Paprican's PS Process", 1998 Pulping Conference, pp. 561–569.
Blain et al, "AQ Pulping: Towards the 21$^{st}$ Century", 1998 Pulping Conference pp. 61–93.
Kleppe et al, "Sulphate Pulping by the Polysulphide Process", *Norsk Skogindusatri,* 11/63, pp. 428–440.
Taga et al, "Two–Stage Cooking Process by the Use of Polysulfides and Alkaline Cooking Liquor" *The High Yield Chemical Pulping Process by the Use of Polysulfides Part 2* pp. 27–32.
Miyao et al, "Stabilization of Cellulose to Hot Alkaline Solution by Treatment with Polysulfide", *Studies on Polysulfide Cooking. III.,* pp. 121–127.
Miyao et al, "Stabilization of Hemicellulose to Hot Alkaline Solution by Treatment with Polysulfide", *Studies on Polysulfide Cooking. V.,* pp. 202–207.
Teder, "The Effect of Lignin on the Stability of Polysulfide Solutions", *Svensk Papperstidning,* Nr. 23, 15 Dec. 1965, pp. 825–833.
Landmark et al, "Cooking Liquor Oxidation and Improved Cooking Technique in Polysulfide Pulping", *TAPPI,* vol. 48, No. 5, May 1965, pp. 56A–58A.
Dillen et al, "On the Influence of Sulphidity and Alkali Charge in Kraft and Polysulphide Pulping of Scots Pine", *Svensk Papperstidning,* Nr 4, Feb. 28, 1967, pp. 122–134.
Olsson et al, "Inorganic Reactions During Polysulfide Cooking", *Svenski Papperstidning,* N4. 20, Oct. 31, 1966, pp. 703–710.
Clayton et al, "Multi–Stage Polysulphide Pulping Processes", *Pulp and Paper Magazine of Canada,* Dec., 1967, pp. T–619–T630.
Järveläet al, "Influence of Cooking Conditions In Two–Stage Polysulfide Pulping", *TAPPI,* vol. 50, No. 3, Mar. 1, 1967, pp. 147–150.
Harlter, "Recent Experiences in Polysulfide Cooking", *TAPPI,* vol. 50, No. 3, Mar. 1967, pp. 156–160.
Ekman et al, "Influence of Cooking Conditions In Two–Stage Polysulfide Pulping", *TAPPI,* vol. 50, No. 2, Feb. 1967, pp. 75–77.
Teder, "Redox Potential of Polysulfide Solutions and Carbohydrate Stabilization", *Svensk Papperstidning,* Nr. 5, Mar. 15, 1968, pp. 149–160.
Sanyer, "Progress and Prostpects of Polysulfide Pulping", *TAPPI,* vol. 51, No. 8, Aug. 1968, pp. 48A–51A.
Barker, "Generation of Polysulfide From Standard Kraft Liquor", *TAPPI,* vol. 53, No. 6, Jun. 1970, pp. 1087–1090.
MacLeod, "Kraft Pulping Variables", *TAPPI,* May 10, 1995, Abstract and pp. 1–75.
Hägglund, "Slutgiltig gestaltning av byggnader ooh apparatutrustning I CCL:s försöksavdelnigar i Svenska Träforskningsinstitutet", *Svensk Papperstidning,* Nr. 5, May 15, 1946, pp. 191–204.
Renard et al, "Analysis of Anthraquinone Impact on Alkaline Pulping Processes", *The American Insitute of Chemical Engineers,* 1980, pp. 182–189.
Holton et al, "Anthraquinone Pulping Process and Supply Considerations", *Fall Conference on Raw Materials and Energy,* San Francisco, California, Nov. 1, pp. 1–24.
Green, "Polysulfide Liquor Generation and White Liquor Oxidation", pp. 257–268.
Kleppe, "Polysulfide pulping in a dual–vessel Kamyr digester", *TAPPI,* vol. 58, No. 8, Aug. 1975, pp. 172–176.
Hilmo, "World's only commercial polysulfide mill reveals advantages and problems", *Pulp & Paper,* pp. 73–76.
Blain et al, "Economics of Aq pulping: The net value of increased production", *Pulp & Paper, Canada,* 1983, pp. 58–63.
Holton, "Soda additive softwood pulping: a major new process", *Pulp & Paper, Canada,* Oct. 10, 1977, pp. 10–24.
Mattar et al, "AQ radicals in alkaline pulping", *TAPPI,* vol. 64, No. 4, Apr. 1981, pp. 136–137.
Hanson et al, "Anthrazuinone pulping . . . is it magic?", *Pulp & Paper,* May 1978, pp. 86–90.
Kettunen et al, "A Case study—converting a kraft mill into a NSAQ mill", *TAPPI Journal,* Oct. 1982, pp. 63–67.
Abbott et al, "Kinetics of soda–anthraquinone delignification", *TAPPI Journal,* Sep. 1982, pp. 127–129.
Werthmann, "Sulfide and anthraquinone–like catalysts delignify wood via different chemical mechanisms in alkaline pulping", *TAPPI,* vol. 65, No., Jul. 1982, pp. 98–101.
Stradal et al, "70%–yield alkaline sulfite–anthraquinone pulp for linerboard", *TAPPI Journal,* vol. 66, No. 10, pp. 75–79.
Eachus, "Effect of soda–anthraquinone pulping conditions on holocellulose fibers", *TAPPI Journal,* Feb. 1983, pp. 85–88.
Furuya, "9% production gain with quinone–additive kraft pulping in a batch digester", *TAPPI Journal,* Jun. 1984, pp. 82–85.
Eckert et al, "Soda anthraquinone pulping of Douglas fir", *TAPPI Journal,* Nov. 1984, pp. 104–108.
Kent et al, "Low Sulfidity Kraft–Anthraquinone Pulping of Hardwood/Softwood Mixtures", *TAPPI Proceedings,* 1983, pp. 69–77.
Green, et al, "The Use of Quinone Additives in Kraft and Polysulfide Pulping", *TAPPI Proceedings,* 1983, pp. 79–84.
MacLeod, "A Review of New Alkaline–Aq Processes", *TAPPI Proceedings,* 1983, pp. 89–91.
MacLeod, "Alkaline sulfite–anthraquinone pulp from aspen", *TAPPI Journal,* Aug. 1986, pp. 102–105.
Sanborn et al, "An evaluation of the sulfite–AQ pulping process", *TAPPI Journal,* Aug. 1986, pp. 102–105.

Malachowski et al, "The effects of anthraquinone on the reaction rate of the kraft pulping of Northeastern white pine", *TAPPI Journal,* Jun. 1989, pp. 207–210.
Ringley, "Westvaco Uses Anthraquinone To Increase Alkaline Pulp Yields", *Pulping Chemicals,* two pages.
Blain et al, "Anthraquinone Pulping: Fifteen Years After", *TAPPI Proceedings,* 1992, pp. 1005–1014.
Wozniak et al, "Lignin–Derived Quinones as Pulping Additivies", *Journal of Wood Chemistry and Technology,* 1989, pp. 535–548.
Kleppe, "Polysulfide AQ Pulping and Oxygen Dramatically Boost Yield, Capacity", *Bleaching Techonology,* pp. 132–136.
Rajan et al, "Extending the Digester Delignification with Anthraquinone", *TAPPI Proceedings,* 1992, pp. 985–1004.
Goyal et al, "Anthraquinone—A Simple Approach for Extended Delignification in Conventional Kraft Pulping", *TAPPI Proceedings,* 1992, pp. 1047–1053.
Sturgeoff et al, "Low–kappa pulping without capital investment: using anthraquinone for low–kappa pulping", *TAPPI Journal,* vol. 77, No. 7, Jul. 1994, pp. 95–100.
Ghosh et al, "Soda–anthraquinone pulping of hardwoods", *TAPPI,* vol. 61, No. 8, Aug. 1978, pp. 57–59.
Leu et al—"Kraft and soda pulping of decayed western hemlock using anthraquinone", *TAPPI,* vol. 63, No. 1, Jan. 1980, pp. 82–83.
Kleppe, "A mill trial with the addition of a small amount of AQ to kraft and polysulfide pulping", *Paperija Puu,* No. 4, 1981, pp. 204–201.
Venemark, "Some Ideas on Polysulfide Pulping", *Svenski Papperstidning,* Nr. 5, Mar. 15, 1964, ten pages.
Chivukula etg al, "Effect of Pretreatment with Green Liquor, AQ and Polysulfide on the Performance of an Extended Batch System", *TAPPI Proceedings,* 1998, pp. 419–429.
Hakanen et al, "Modified kraft cooking with polysulfide: yield, viscosity, and physical properties", *TAPPI Journal,* vol. 80, No. 7, Jul. 1997, pp. 189–196.
Berthold et al, "Polysulfide addition as a means to increase delignification in kraft pulping", *Nordic Pulp and Paper Research Journal,* vol. 12, No. 4/ 1997, pp. 230–236.
Dahlborn et al, "The characteristics of MSS–AQ pulping—a new pulping process", *TAPPI Journal,* Mar. 1990, pp. 257–261.
Burazin et al, "Building a mechanistic model of kraft–anthraquinone pulping kinetics", *TAPPI Journal,* Mar. 1988, pp. 165–169.
MacLeod et al, "The strenghts of kraft–AQ and soda–AQ pulps—Bleachable–grade pulps", *TAPPI,* vol. 63, No. 1, Jan. 1980, pp. 57–80.
Mortimer et al, "Substituting AQ for AA in kraft pulping", *TAPPI Journal,* vol. 68, No. 10, Oct. 1985, pp. 111–113.
Green et al, "Polysulphide pulping of two Canadian softwood blends", *Pulp & Paper, Canada,* 76, No. 9, Sep. 1975, 4–page reprint.
8–page brochure of Mead Chemical Systems entitled "MOXY System I".
Smith et al, "Polysulfide Liquor Generation with Moxy System I", *TAPPI Proceedings*, 1974, 15 pages.
Kleppe, "Polysulfide pulping in a dual–vessel Kamyr digester", *TAPPI,* vol. 58, No. 8, Aug. 1975, pp. 172–176.
Teder et al, "Low–kappa–number polysulfide pulps are easy to bleach", *TAPPI,* vol. 64, No. 4, Apr. 1981, pp. 138–139.
Kleppe, "Polysulfide AQ Pulping and Oxygen Dramatically Boost Yield, Capacity", *Pulp & Paper,* Jun. 1988, pp. 49–53.
Hara, "New Polysulfide Pulping Process at Shirakawa and Hachinohe", *TAPPI Proceedings,* 1991, pp. 107–113.
Ghosh, "Evaluation of Anthraquinone Additives in Soda Pulping of Hardwood (Water Oak: *Quercus Nigra*) —Pulping Characteristics, Kinetics and Economics", Thesis submitted to the Graduate Faculty of North Carolina State University, Department of Wood and Paper Science, Raleigh 1979, 152 pages.
Hart et al, "Anthraquinone Pulping of Non–Wood Species", *TAPPI Proceedings,* 1993, pp. 585–593.
Sturgeoff, "Low Kappa Pulping Without Capital Investment—Use of Anthraquinone for Low Kappa Pulping", *TAPPI Proceedings,* 1993, pp. 423–429.
Lindblad et al, "The Effect of Anthraquinone on the Pulp Yield in Modified Kraft Pulping of Birch", paper presented in Stockholm, Jan. 1987, 30 pages.

CELLULOSE SLURRY TREATING SYSTEMS FOR ADDING AQ TO A CELLULOSE SLURRY IN THE SUBSTANTIAL ABSENCE OF ALKALI

CROSS-REFERENCE TO RELATED APPLICATION

This application is a division of application Ser. No. 09/658,910, filed Sep. 12, 2000, pending, the entire content of which is hereby incorporated by reference in this application.

This application is based upon provisional application Ser. No. 60/153,237 filed Sep. 13, 1999, the disclosure of which is incorporated by reference herein.

BACKGROUND AND SUMMARY OF THE INVENTION

Co-pending patent application Ser. No. 09/248,009 [10-1265], filed on Feb. 10, 1999 (the complete disclosure of which is included by reference herein), discloses a method of treating comminuted cellulosic fibrous material with a beneficial additive prior to chemical digestion. This additive is preferably a strength- or yield-enhancing additive, such as athraquinone [AQ] or polysulfide [PS] and their derivatives or equivalents. The present invention comprises a further method and apparatus for effecting the pretreatment of comminuted cellulosic fibrous material, typically wood chips (though the invention is equally applicable to the treatment of other forms of cellulose), to improve the properties [e.g. strength] of the resulting pulp or to improve the effectiveness [e.g. yield] of the pulping process.

It has been discovered that the pretreatment of comminuted cellulosic fibrous material, for example, wood chips, can be more effective if, among other things, the heating and cooking of the chips after pretreatment is essentially isolated from the pretreatment process. That is, a more effective pretreatment can be obtained if the pretreatment process is performed at a cooler temperature, with or, preferably substantially without, the presence of alkali, and the heating of the chips to cooking temperature is performed after the pretreatment (impregnation of the cellulose material) is essentially completed. In one aspect of this invention the additive is added earlier in the treatment process, and the content of cooking chemical, for example, kraft white liquor, is reduced or diverted from this earlier stage of pretreatment and introduced during later stages of pretreatment or in the formal cooking treatment. Thus, according to the present invention, possibly longer, cooler, less alkaline pretreatment is provided so that the cooking additive more effectively treats the chips prior to heating to cooking temperature, that is, to a temperature greater than 140° C.

According to one aspect of the present invention there is provided a method of continuously producing chemical cellulose pulp from a comminuted cellulosic fibrous material slurry, comprising substantially continuously: (a) Impregnating the material with a solution containing yield or strength-enhancing additive at effective alkali and temperature conditions so that substantially no alkali degradation of the cellulose occurs, and so that little or substantially no acid hydrolysis occurs. And, (b) after (a), treating the material with an alkaline cooking liquor, at cooking temperature, to produce a chemical cellulose pulp with higher yield or strength than if (a) were not practiced.

In the method (a) may be practiced so that there also is substantially no dissolution of lignin from the material. At the end of (a), the material has been impregnated with the yield or strength enhancing additive (such as AQ or its derivatives or equivalents) so that the problems associated with conventional higher temperature additive impregnation are avoided. For example specifically with respect to AQ, it is a large molecule and needs a longer time to diffuse into the wood chips, or like cellulose material, than does for example, alkali, and it needs to be reduced in order to dissolve so that it can diffuse. Therefore sometimes AQ is used in its reduced form (commonly referred to as SAQ). However also typically about 80% of the AQ reacts with dissolved lignin and thus is not capable of performing its intended yield and strength enhancing function, leaving only about 20% of the AQ for performing the desired functions. By utilizing the invention a much higher percentage of the AQ (up to substantially all) that is added actually impregnates the wood chips and performs its yield or strength enhancing function, and the AQ may or may not be added in reduced form. When the AQ successfully impregnates the chips it keeps the hemicellulose from being dissolved during cooking, and thus increases yield, and utilizes other mechanisms to enhance strength. Other materials may also be utilized to facilitate penetration of the chips with the additive, such as the use of a surfactant.

In the method as described above (a) may be practiced at an alkali concentration between 0-less than 10 g/l expressed as NaOH, and at a temperature of between about 80–130° C., typically less than about 120° C. and preferably about 110° C. or less. The amount of alkali is most desirably substantially zero, but preferably at most less than about 5 g/l expressed as NaOH.

In the method (a) may be practiced in a feed system of a continuous digester and (b) in a continuous digester. Exactly where in the feed system (a) is practiced may be widely variable. For example a chip bin could be located in a wood yard, and the additive could be sprayed or otherwise applied to the wood chips even prior to entry into the chip bin, or while they were entering the chip bin, or while they were in the chip bin. Then the wood chips could be pumped from the wood yard to the digester using primarily or substantially exclusively water as the slurrying medium (with no intentional significant alkali addition) so that the chips would be at desirable low temperature, low alkali, impregnation-facilitating conditions for a significant period of time. In a typical situation impregnation in (a) will take at least about 20 seconds, e.g. between about 2–60 minutes at superatmospheric pressure (which superatmospheric pressure may be provided in any conventional manner including by a level of liquid above the chips, pumping, and/or in a pressure vessel). Alternatively the additive may be introduced after the chip bin and before a pump and/or high pressure feeder, in a separate treatment vessel such as an impregnation vessel, or any other location in the feed system that proves advantageous for any reason.

The invention may also comprise substantially immediately after impregnation in (a) adding between about 35–100% of the alkali used to treat the material, including in (b), to the material. Alternatively the alkali can be added far downstream. Also the method may further comprise (c), between (a) and (b), treating the material in a second zone with a solution containing additive at an effective alkali concentration of about 5—less than 15 g/l expressed as NaOH and greater than in (a), and at a temperature of between about 110–130° C. and higher than in (a).

In the method (a) may be practiced using as the additive at least one of AQ or its derivatives or equivalents, polysulfide or its derivatives or equivalents, or sulfite in the form of sulfur dioxide, $NaHSO_3$, or $Na_2SO_3$. A suitable amount of additive may be used; for example if AQ or its derivatives or equivalents are used, typically (a) is practiced with a total additive concentration of between about 0.02–0.5% on wood, typically between about 0.02–0.1% on wood.

Additive may also be added during the digesting process, as is conventional.

According to another aspect of the present invention there may be provided a method of treating comminuted cellulosic fibrous material comprising substantially continuously: (a) Treating a slurry of comminuted cellulosic fibrous material with a first liquid comprising primarily or substantially exclusively water containing a beneficial additive at a maximum effective alkali concentration of less than 10 g/l, and at a first temperature of about 80–130 degrees C., for at least about 20 seconds, e.g. between about 2–60 minutes under superatmospheric pressure. And, (b) after (a), treating the material in the slurry with a second liquid having an initial effective alkali concentration greater than 10 g/l (preferably greater than 15 g/l and most desirably greater than 20 g/l) expressed as NaOH, and at a second temperature greater than 130° C. (e.g. greater than 140° C.), to produce a chemical cellulose pulp.

The method as described above may further comprise (c), between (a) and (b), treating the slurry with a third liquid containing the beneficial additive at a maximum effective alkali concentration greater than the first liquid and less than the second liquid, and at a third temperature, higher than the first temperature and less than 140 degrees C.

Another embodiment of the present invention may be a method of treating comminuted cellulosic fibrous material consisting of or comprising: (a) treating (e.g. pre-treating) a slurry of comminuted cellulosic fibrous material with a liquid containing a beneficial additive at a first alkali content, e.g. from 0—less than 10 g/l, at a first temperature; (b) after (a), treating the slurry with a second liquid containing a beneficial additive at a second effective alkali content, greater than zero, and preferably at least 10% greater than the first effective alkali content, at a second temperature higher than the first temperature; and (c) after (b), treating [possibly, although not necessarily, after displacement of substantially all of the additive therefrom] the slurry with a third liquid having an effective alkali content (i.e. concentration) greater than the first and second effective alkali contents and a temperature greater than the first and second temperatures and greater than 130° C. (e.g. greater than 140° C.) to produce a chemical cellulose pulp.

As described above, the beneficial additive used in steps (a) and (b) may be AQ (most desirably SAQ), polysulfide, sulfur, surfactants, and combinations thereof. The first alkali content, expressed as "effective alkali" [EA] as NaOH, is preferably less than 10 g/l, and may be less than about 5 g/l, or the first liquid may contain no alkali at all. For example, the first liquid may be mill water, steam condensate, or washer filtrate containing little or no alkali content. The first temperature of treatment (a) is preferably a relatively cool temperature, that is, a temperature less than 130° C., preferably less than about 120° C., for example, the first temperature may range from about 90 to 110° C., or be even lower.

Procedure (a) may be performed using the methods and apparatuses described in U.S. Pat. Nos. 5,476,572; 5,622,598; and 5,632,025, that is the system marketed under the trademark LO-LEVEL® feed system by Andritz-Ahlstrom Inc. of Glens Falls, N.Y. The LO-LEVEL® feed system, that is a system employing a chip pump and not using a horizontal "steaming vessel", is particularly suited for treatment according to the present invention since this system allows for the feeding and treatment of chips at lower temperatures than can be handled by conventional feed systems. Other conventional equipment and processes may also be used to perform the present invention, for example, those not including a chip pump and including a horizontal steaming vessel.

The second liquid of step (b) preferably contains at least some alkali, for example, the second liquid contains less than 15 g/l EA, typically about 5 to 10 g/l EA. This alkali content may be supplied by kraft white, green, or black liquor, or from combinations of white, green, or black liquor and water or washer filtrate. The second temperature is also preferably less than 140° C., for example, less than about 120° C., and is typically between about 110 and 130° C. The procedure (b) is typically performed in the upper part of continuous digester, for example, a Kamyr® continuous digester as also sold by Andritz-Ahlstrom Inc. of Glens Falls, N.Y.

Procedure (c), the formal pulping process, may be any form of chemical pulping process, but is preferably one or more of the processes described in U.S. Pat. Nos. 5,489,363; 5,536,366; 5,547,012; 5,575,890; 5,620,562; 5,662,775 and others. The processes and apparatuses described in these patents are marketed under the name LO-SOLIDS® Pulping by Andritz-Ahlstrom.

According to another aspect of the present invention there is provided a method of continuously producing chemical cellulose pulp from a comminuted cellulosic fibrous material slurry, comprising continuously: (a) In a first treatment zone treating the material with a solution containing yield or strength-enhancing additive at effective alkali and temperature conditions so that substantially no alkali degradation of the cellulose occurs (and so that the material and additive flow in contact with each other for a period of time). (b) After (a), treating the material in a second zone with a solution containing additive at an effective alkali concentration of about 5—less than 15 g/l expressed as NaOH, and at a temperature of between about 110–130° C. and higher than in (a). And (c) after (b) (and possibly, but not necessarily desirably, after removing substantially all of the additive from contact with the material), treating the material with an alkaline cooking liquor, at cooking temperature, to produce a chemical cellulose pulp with higher (e.g. at least 2% higher) yield or strength than if (a) and (b) were not practiced.

In the method preferably (a) is practiced in a feed system of a continuous digester, (b) is practiced in a top zone of the continuous digester, and (c) is practiced in the continuous digester below the top zone. Also, preferably (a) is practiced at an alkali concentration between 0—less than 10 g/l expressed as NaOH, and less than in (b), and at a temperature of between about 80–110° C. At least 50% of the additive may be introduced in (a), or about 40% may be introduced in (a) and 60% of the additive introduced elsewhere, for primary use in (b). In an embodiment wherein the additive is AQ or its derivative or equivalents, and wherein (a) and (b) are practiced with a total additive concentration of between about 0.05–0.15% on pulp.

The apparatus used in practice of the present invention is primarily conventional apparatus, except, for some aspects, for the additive additions to the feed system, and to the top zone of a continuous digester, and the potential recirculation of additive withdrawn from the top zone (including a screen at a transition between the top zone and the cooking zone of the continuous digester) and introduction to the feed system.

According to another aspect of the present invention there is provided a cellulose slurry treatment system comprising:

An upright continuous digester having an inlet adjacent the top and an outlet adjacent the bottom thereof. A feed system for the digester including a slurry pump. A yield or strength-enhancing additive conduit for introducing yield or strength-enhancing additive into the slurry before the slurry pump. A top treatment zone of the digester, and a screen assembly adjacent the bottom of the top treatment zone, and a cooking zone below the screen assembly. The screen assembly providing a temperature transition within the digester. Means for introducing or re-circulating liquids into the digester so as to establish upward flow of liquid in the digester above the screen. And means for introducing yield or strength-enhancing additive into the top zone and/or feed system of the digester.

In the system, the means for introducing additive into the feed system may comprise conventional conduits, nozzles, venturis, or other conventional structures capable of introducing a liquid into a flowing liquid or slurry. The means for introducing liquid into the digester to ensure upward flow immediately adjacent the screen assembly (which preferably comprises the second screen in the digester going from the top to the bottom) comprises any conventional structure that will accomplish that purpose, including re-circulation conduits with central pipes connected to pumps, etc. The invention also preferably comprises means for re-circulating additive withdrawn from the top zone of the digester to the additive introduction means associated with the feed system. Such re-recirculation means may comprise conventional conduits, and/or pumps, valves, or like fluid structures for that purpose, and may also include separation equipment for separating the additive from some of the liquid with which it is re-circulated. The preferred additives are those described in co-pending application Ser. No. 09/248,009.

It is the primary object of the present invention to provide for the effective treatment of comminuted cellulosic fibrous material so as to increase the strength, yield, and/or other advantageous properties of the pulp or the treatment process. This and other objects of the invention will become clear from an inspection of the detailed description of the invention and from the appended claims.

DETAILED DESCRIPTION OF THE DRAWINGS

Figure 1:
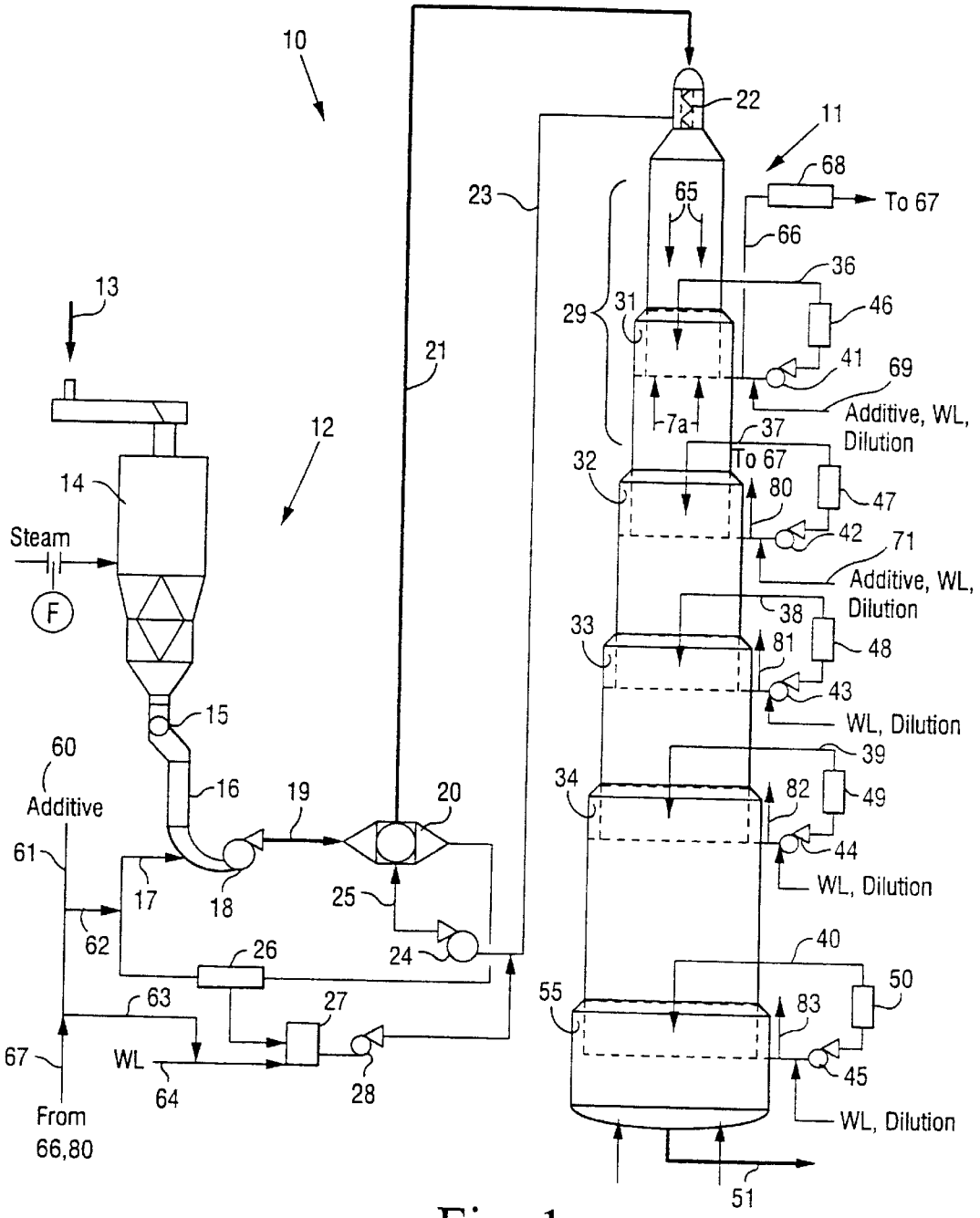
FIG. 1 is a schematic representation of exemplary apparatus for practicing the method according to the present invention, and comprising an exemplary system according to the present invention.

FIG. 1 illustrates one preferred embodiment of the present invention. FIG. 1 illustrates a comminuted cellulosic fibrous material treatment system 10 consisting essentially of or comprising a continuous digester 11 and a continuous digester feed system 12. Feed system 12 may be a LO-LEVEL® feed system as sold by Andritz-Ahlstrom, but any conventional feed system for introducing, steaming, and slurrying comminuted cellulosic fibrous material may be used; and/or one or more separate impregnation vessels may be used; and/or unconventional systems, such as those including equipment and/or a chip bin in the wood yard with pumping to the digester. Also in some circumstances a plurality of impregnation ponds may be used. with slurry pumped from a particular pond once impregnation with additive is complete (or will complete during pumping).

Comminuted cellulosic fibrous material, for example, in the form of softwood chips 13, are introduced to an isolation device 14 which forwards the chips to steam treatment in a vessel 14, which is preferably a vessel as described in U.S. Pat. Nos. 5,500,083; 5,617,975; 5,628,873; 4,958,741; and 5,700,355, and marketed by Andritz-Ahlstrom under the trademark DIAMONDBACK®, though other types of steaming vessels may be used. From vessel 14 the chips pass through a metering device 15 to a conduit 16, which is preferably a Chip tube provided by Andritz-Ahlstrom. Slurry liquid is introduced to the chips in conduit 16 by way of a conduit 17 so that a level of liquid is maintained in conduit 16. The slurry of chips and liquid is fed to the inlet of chip pump 18 which pressurizes and feeds the slurry to the inlet of high-pressure transfer device 20 via a conduit 19.

The device 20 is typically a High-pressure Feeder as sold by Andritz-Ahlstrom. The device 20 further pressurizes the slurry to a pressure of between about 5 and 15 bar and propels the slurry via conduit 21 to the top of the continuous digester 11. Excess liquor contained in the slurry is removed from the slurry at the inlet of the digester 11 by a separating device 22, typically a conventional Top Separator, and the excess liquid is removed and returned to feed system 12 via conduit 23 and pump 24. The pressurized slurry provided by pump 24 and conduit 25 provides the motive force for propelling the slurry from feeder 20 to digester 11.

Feed system 12 also typically includes conventional devices such as In-line drainer 26, Level Tank 27, and Make-up Liquor Pump 28. Cooking liquor, for example, kraft white liquor (WL) is typically provided to the Level Tank 27 as is conventional.

Digester 11 typically includes a plurality of annular screen assemblies 31, 32, 33, 34 and 35. Though five such screen assemblies are schematically illustrated in FIG. 1, the present invention may be effected in a digester with any number of screens, from two to five, or even more. Each screen assembly 31–35 typically includes an extraction with a recirculation conduit, 36 through 40; a pump, 41 through 45; and a heat exchanger, 46 through 50. Essentially fully-treated pulp is discharged via conduit 51 from the bottom of the digester 11.

According to the present invention, cooking additive 60, for example AQ, polysulfide, etc. is introduced to the feed system 12 via one or more conduits 61, 62, or 63. Alkali containing liquor for example, kraft white, green, or black liquor or washer filtrate is introduced to feed system 12 via conduit 64, or significant alkali introduction (i.e. 10 g/l or more, or 5 g/l or more) can be delayed until later (i.e. no significant alkali addition in the feed system at all, except perhaps to lubricate the feeder 20 or like equipment). Typically the sources of alkali provides an effective alkali concentration [AG] of less than 10 g/l as NaOH, preferably less than about 5 g/l as NaOH. In one embodiment of this invention, the liquid introduced to conduit 64 contains little or no alkali, for example, the liquid introduced may be water, condensate, hot black liquor, or weak black liquor.

According to the present invention, the temperature in feed system 12 is preferably kept below 130° C., that is, preferably between about 80 and 130° C., and most desirably less than about 120° C., or even less than about 110° C., and the alkali content is low enough so that little or no alkali degradation of the cellulose occurs, and substantially no dissolution of lignin, during the treatment with the additive, such as AQ. Penetrants, such as surfactants, may also be introduced with the additive to enhance the treatment of the additive or the penetration or the alkali into the chips. Though the LO-LEVEL® Feed system is suited to low temperature treatment of this kind, this treatment may also be effected in a conventional feed system by reducing the temperature in the feed system, for example, reducing the pressure in the horizontal steaming vessel and/or using a cooling heat exchanger to cool the liquor in and around the feed system to prevent liquor flash evaporation, or other equipment may be utilized.

Desirably after this pretreatment at low temperature and little or no alkali, the material is cooked with conventional alkali cooking liquor (e.g. the kraft, sulfite, or other alkali processes), to produce chemical pulp. Treatment with a cook level of alkali (e.g. initially over 30 g/l expressed as NaOH) may be substantially immediately after the additive-impregnation, or those may be intermediate steps or treatments. One such intermediate treatment is seen in FIG. 1.

In FIG. 1, after pretreatment in the feed system 12, the pretreated slurry is transferred via conduit 21 to the digester 11 for further pretreatment (at the top of digester 11, e.g. in zone 29) and for formal cooking (in the middle of the digester 11, below the vicinity of screen 32). After passing through separator 22 the chip slurry preferably still at a temperature less than about 120° C. passes downwardly as schematically shown by arrows 65, until screen 31 is reached. At screen 31 some of the liquid in the slurry is removed from the slurry. Some of the removed slurry may be removed via conduit 66, and used or treated elsewhere, and/or some of the liquid may be removed and circulated via conduit 36 back to the vicinity of screen 31. The re-circulated liquor is pumped by pump 41 and may or may not be heated or cooled by heat exchanger 46. The liquid in conduit 66 typically contains at least some additive. This additive may be returned to feed system 12, for example, by introducing it to conduit 67. The liquid in conduit 66 may be cooled by the heat exchanger 68. Cooking chemical, additive, dilution liquid, or a combination thereof may be added to circulation 36 via conduit 69.

The slurry of material passes screen 31 and then encounters screen 32. According to the present invention, removal of liquid from screen 31 preferably causes a countercurrent flow of liquid relative to the flow of chips between screens 31 and 32 schematically shown by arrows 70. At screen 32, additional liquid is removed and re-circulated via pump 42, conduit 37 and heat exchanger 47, with or without heating. Again, additive, dilution, cooking liquor, and/or combinations thereof, may be introduced to circulation 37 via conduit 71. Heat may be introduced to circulation 47 so that the slurry temperature increases to a temperature greater than 120° C. while passing screen 32. In one mode of operation, the flow of liquid above screen 32 is upward and the flow of liquid below screen 32 is downward so that a temperature separation is established in the vicinity of screen 32.

In the zone 29, the slurry includes additive (e.g. AQ), and if there is a proper alkali addition is at a second alkali concentration (e.g. about 5—less than 15 g/l and greater than the first alkali concentration in the feed system 12), and at a second temperature (e.g. about 110–130° C.) which is greater than in the first temperature in the feed system 12. In the zone 29 a small amount of alkali degradation may take place, but effective treatment with additive also takes place.

After passing the screen 32, the slurry is typically heated to formal cooking temperature, that is, to a temperature greater than 140° C., and the formal cooking process commences. Some of the additive may pass into the cooking process, but alternatively the additive may be partially or substantially completely (e.g. more than 90%) removed prior to the cooking process commencing, e.g. being displaced in conduit 80.

According to the present invention, pretreatment additive is introduced to feed system 12, and the chips are treated with additive prior to introducing the chip slurry to digester 11. This treatment is preferably performed at a temperature less than 120° C. In the case of AQ, the additive concentration is typically less than 0.20% on pulp and is typically between about 0.02 and 0.5% on pulp. About 50% of the AQ may be introduced via conduit 61 and about 25% introduced to conduits 69 and 71. Also, all the AQ, that is substantially 100%, may be introduced to feed system 12 (or otherwise before significant alkali addition), and little or no AC introduced to digester 11. In another embodiment about 40% of the AQ is introduced to feed system 12 and about 60% is introduced to the digester 11.

Less than 50% of the total alkali introduced to system 10 may be introduced to feed system 12. This may be less than about 40% or even about 30%. In one embodiment, no alkali is introduced to the feed system 12, that is, during treatment in the feed system 12, the chips may essentially only be exposed to the additive and primarily water (whether fresh, in the form of filtrate, etc.).

The treatment time in the feed system 12, the top zone 29 of the digester 11, and in the cooking zone (below 32) in the digester 11, may be varied depending upon the particular material being treated, and other factors. With typical softwood, the treatment time with additive in the feed system 12 (that is under conditions so that substantially no alkali degradation of the cellulose occurs) is about 2–60 minutes, whereas—if used—treatment in the zone 29 (at alkali and temperature conditions slightly higher than in the feed system 12) has a treatment time of about 20–60 minutes, and the cook time is conventional, e.g. about 1–3 hours.

Associated with each of the screens assemblies 33–35 there also may be extraction conduits 81–83, which can be sent to flash tanks and chemical recovery, or simply for extracting liquid having relatively high levels of dissolved organic material during LO-SOLIDS® cooking processes. Instead of a single vessel system, multiple vessel systems (including an impregnation vessel) may be used with significant alkali addition (except to keep equipment free running) only at the end of, or after, the impregnation vessel.

In the above disclosure all specific ranges within each broad range are also specifically disclosed herein. For example, and example only, an EA of less than 10 g/l means 0–1 g/l, 0.2–5 g/l, 3–8 g/l, and all other narrower ranges within the broad range.

While the invention has been shown and described in what is conceived to be the most practical and preferred embodiment thereof it will be apparent to those of ordinary skill in the art that many modifications may be made thereof within the scope of the invention, which scope is to be accorded the broadest interpretation of the appended claims so as to encompass all equivalent processes and systems.

What is claimed is:

1. A cellulose slurry treatment system comprising:

an upright continuous digester having an inlet adjacent the top and an outlet adjacent the bottom thereof;

a feed system far the digester including a slurry pump;

a source of anthraquinone (AQ) solution comprising AQ in the substantial absence of alkali;

an additive conduit for introducing the AQ solution into the slurry before said slurry pump:

a top treatment zone of said digester, and a screen assembly adjacent the bottom of the top treatment zone, and a cooking zone below said screen assembly;

said screen assembly providing a temperature transition within said digester;

means for introducing or re-circulating liquids into said digester so as to establish upward flow of liquid In said digester above said screen; and means for introducing the AC solution into said top zone and/or feed system of said digester in the substantial absence of alkali to achieve an effective alkali condition of substantially zero.

2. A system as recited in claim 1, further comprising means for re-circulating the AQ solution from the top zone of said digester to said additive conduit for introducing the AQ solution into the slurry before said slurry pump.

* * * * *